United States Patent [19]

Yoshimoto et al.

[11] Patent Number: 4,791,026

[45] Date of Patent: Dec. 13, 1988

[54] SYNTHETIC POLYMER MULTIFILAMENT YARN USEFUL FOR BULKY YARN AND PROCESS FOR PRODUCING THE SAME

[75] Inventors: Masato Yoshimoto, Ibaraki; Shinji Ohwaki, Minoo, both of Japan

[73] Assignee: Teijin Limited, Osaka, Japan

[21] Appl. No.: 122,255

[22] Filed: Nov. 18, 1987

[30] Foreign Application Priority Data

Nov. 27, 1986 [JP] Japan ..... 61-280807

[51] Int. Cl.[4] ..... D02G 3/00

[52] U.S. Cl. ..... 428/397; 428/373; 428/374; 428/398; 428/399; 264/167; 264/168; 264/209.1; 264/177.2

[58] Field of Search ..... 428/373, 374, 397, 398, 428/399

[56] References Cited

U.S. PATENT DOCUMENTS

| | | | |
|---|---|---|---|
| 3,200,576 | 8/1965 | Maerov et al. | 264/103 |
| 4,084,622 | 4/1978 | Nakagawa et al. | 57/310 |
| 4,153,660 | 5/1979 | Reese | 264/103 |
| 4,332,757 | 6/1982 | Blackman et al. | 264/177.13 |
| 4,349,604 | 9/1982 | Blackman et al. | 428/373 |
| 4,546,043 | 10/1985 | Yoshimoto et al. | 428/373 |
| 4,631,162 | 12/1986 | Yoshimoto et al. | 264/167 |
| 4,661,404 | 4/1987 | Black | 428/499 |

FOREIGN PATENT DOCUMENTS

| | | | |
|---|---|---|---|
| 1239009 | 10/1986 | Japan | 428/398 |

OTHER PUBLICATIONS

Derwent Abstract 78-00972A/01, of Japanese Patent 81-049322.

Derwent Abstract 77-023384/02, of Japanese Patent 84-20003.

*Primary Examiner*—Sharon A. Gibson

*Attorney, Agent, or Firm*—Burgess, Ryan & Wayne

[57] ABSTRACT

A synthetic polymer multifilament yarn capable of being converted to a bulky yarn is composed of a plurality of irregular individual filaments each having at least two belt-shaped filamentary constituents, at least one core filamentary constituent located between the belt-shaped constituents and extending in a sinuous manner and having a thickness varying alternately between thick and thin, and at least two thin middle filamentary constituents located between the core constituent and the belt-shaped constituents to thereby connect those constituents to each other. In each cross-sectional profile of the individual filaments, the core constituent has an inscribed circle having a diameter (lB), the belt-shaped constituents have a substantially I-shaped cross-section, the middle constituents have a waist-formed cross-sectional profile having a narrowest portion thereof, and the diameter (lB) is larger than diameters (lC) of inscribed circles of cross-sectional regions each consisting of a cross-section of a belt-shaped constituent and a half portion of a waist-formed cross-section of a middle constituent located between the belt-shaped constituent and a line drawn along the narrowest portion of the middle constituent.

17 Claims, 7 Drawing Sheets

SYNTHETIC POLYMER MULTIFILAMENT YARN USEFUL FOR BULKY YARN AND PROCESS FOR PRODUCING THE SAME

BACKGROUND OF THE INVENTION

1. Field of the Invention

The present invention relates to a synthetic polymer multifilament yarn and a process for producing the same. More particularly, the present invention relates to a synthetic polymer multifilament yarn capable of being converted to a bulky yarn and of being evenly dyed, and useful for woven or knitted fabrics having a silky gloss and draping property, and a process for producing the same.

2. Description of the Related Arts

It is known from, for example, U.S. Pat. No. 3,200,576, that a synthetic polymer multifilament yarn capable of being converted to a bulky yarn by applying heat thereto is prepared by mixing two types of filaments having a different thermal shrinkage. When this type of multifilament yarn is heat-treated a large shrinkage of the high shrinkage filaments in the yarn occurs, causing the low shrinkage filaments in the yarn to overhang from the yarn and thus make the yarn bulky.

Where the high shrinkage filaments have a large thickness and the low shrinkage filaments have a small thickness, the resultant heat-treated multifilament bulky yarn exhibits a high modulus and a soft touch.

U.S. Pat. No. 4,153,660 discloses a process for producing a multifilament yarn capable of being converted to a bulky yarn by a heat treatment in a manner such that a polymer melt is extruded through a number of spinning orifices, a number of the resultant polymer melt filamently streams are rapidly cooled, the resultant undrawn filaments are divided into two bundles, each consisting of a plurality of individual filaments, an aqueous spinning-finishing agent is applied to a filament bundle, and a finishing agent having a higher boiling temperature than that of water is applied to the other filament bundle. The two bundles are then separately drawn under the same conditions while being heat-treated, and the drawn bundles are incorporated with each other to mix the two types of filaments having a different heat shrinkage.

The above-mentioned process imparts different thermal shrinkage to the two separate filament bundles due to the difference in boiling temperature between the two different finishing agents. However, the separate applications of the two different finishing agent make the process very complicated.

Where two separate types of filament having different deniers are produced from the same type of filaments extruded through the same spinneret, undesirable adhesion or breakage of the filaments often occurs due to lateral movement of the filaments extruded through the spinneret. To prevent this, the spinning process conditions, including a draft for the filaments and a flow rate of cooling air, must be strictly controlled.

U.S. Pat. Nos. 4,332,757 and 4,349,604 disclose a process for producing a multifilament yarn capable of being converted to a bulky yarn, which process does not entail the above-mentioned complicated operations.

In this process, a polymer melt is extruded through two separate spinning openings having different opening diameters and facing each other at a predetermined angle, the extruded two separate filamentary streams of the polymer melt are brought into contact with each other immediately below the spinneret, while one filamentary stream is made to travel in a sinuous manner, the resultant composite filamentary stream of the polymer melt is rapidly cooled, and the resultant solid filament is taken up.

The resultant individual filament, which is referred to as a pulsing filament, has a shrinkage varying not only in the longitudinal direction but also in the lateral direction thereof.

Usually, the multifilament yarn is converted to a woven or knitted fabric and then a heat treatment is applied to the fabric to convert the multifilament yarn to a bulky yarn, and accordingly, the fabric to a bulky fabric.

However, the bulky fabric produced from the pulsing multifilament yarn usually exhibits an unsatisfactory bulkiness. This is because, due to the restriction effect of the weaving or knitting structure of the fabric to shrinkage of the multifilament yarn therein, the shrinking force of the pulsing filament yarn is not sufficiently large, and therefore, the shrinkage of the pulsing filament yarn is restricted.

Also, the pulsing filament yarn has an disadvantage in that, when a drawing operation and heat-setting operation are applied to the yarn to impart the enhanced mechanical properties necessary for practical use to the yarn, the local difference in shrinkage retained in the pulsing filaments is lost, and accordingly, the pulsing multifilament yarn must be utilized to produce a bulky yarn or fabric without applying the drawing and heat-setting procedures thereto. Therefore, the bulky yarn or fabric produced from the pulsing multifilament yarn sometimes exhibits an uneven shrinkage and a local plastic deformation of the individual filaments when a stress is applied to the yarn or fabric.

U.S. Pat. Nos. 4,546,043 and 4,631,162 disclose a synthetic polymer multifilament yarn capable of being uniformly converted to a bulky yarn having a high bulkiness without generating an undesirably uneven shrinkage and plastic deformation. In this type of multifilament yarn, each individual filament is composed of a hollow filamentary constituent, a non-hollow, sinuous filamentary constituent in a wave form having a smaller thickness than that of the hollow filamentary constituent, and a middle filamentary constituent through which the hollow filamentary constituent is connected to the non-hollow filamentary constituent. This type of multifilament yarn is produced by extruding a synthetic polymer melt through a plurality of spinning orifices each consisting of a hollow filament-forming orifice segment, a non-hollow filament-forming orifice segment having a size smaller than that of the hollow filament-forming orifice segment, and a thin slit-formed orifice segment through which the hollow filament-forming orifice segment is connected to the non-hollow filament-forming orifice segment. A portion of the polymer melt is extruded through the non-hollow filament-forming orifice segment at a larger extruding rate than that of the portion extruded through the hollow filament-forming orifice segment, and the resultant non-hollow filamentary stream of the polymer melt travels in a sinuous manner, while being connected to a hollow filamentary stream of the polymer melt extruded through the hollow filament-forming orifice segment, through a filamentary stream of the polymer melt extruded through the thin slit-formed orifice segment.

The resultant connected filamentary streams are solidified by cooling and taken up.

In this type of the multifilament yarn, each individual filament has a large difference in shrinkage between the hollow filament constituent and the non-hollow filament constituent thereof, and thus can be converted to a high bulky yarn even after the multifilament yarn is drawn.

However, when the above-mentioned type of multifilament bulky yarn is converted to a woven or knitted fabric, the resultant fabric sometimes exhibits an uneven dyeing property, and therefore, the above-mentioned multifilament yarn is not useful for high quality woven or knitted fabrics required to have a silky gloss and draping property and to exhibit a beautiful and elegant appearance and touch.

Recently, the high quality woven or knitted fabrics are further required to exhibit an enhanced wearing comfort, and thus to have a high antistatic property and an improved moisture-absorbing property. Accordingly, new types of synthetic polymer multifilament yarns having the above-mentioned enhanced properties are in demand when making more comfortable cloth.

The inventors of the present invention found that the shrinkage of the multifilament yarn disclosed in U.S. Pat. Nos. 4,546,043 and 4,631,162 is too uneven, due to the unevenness in the thickness of the individual filaments in the longitudinal direction thereof, and therefore, the woven or knitted fabrics composed of the multifilament yarn are dyed unevenly.

The unevenness in the shrinkage of each individual filament along the longitudinal axis of the filament can be eliminated by controlling the variance in the thickness of the filament along the longitudinal axis of the filament, and by controlling the difference in the extruding rate of the hollow filamentary constituent stream and the non-hollow filamentary stream of the polymer melt.

However, if the difference in the extruding rate is controlled to a too small level, the variance in the thickness in the filament becomes too small, and although this too small variance in the thickness results in a too small bulkiness of the resultant yarn or fabric, it is effective for removing the unevenness in dyeing of the resultant yarn or fabric. Also, it was found that, when the hollow filamentary stream of the polymer melt extruded at a low extruding rate is brought into contact with the non-hollow filamentary stream of the polymer melt extruded at a high extruding rate, the resultant individual filament has a large unevenness in thickness of the filament along the longitudinal axis of the filament.

In view of the above-mentioned, it was assumed by the inventors of the present invention that, if the thickness of the high extruding rate filamentary stream of the polymer melt could be varied in a pulsing condition without coming into direct contact with the low extruding rate filamentary stream, the aforementioned objects of the present invention could be attained.

In an attempt made on the basis of that assumption, a polymer melt was extruded through a complicated spinning opening composed of at least two I-shaped opening segments facing the core opening segment arranged between the I-shaped opening segments and at least two thin slit-shaped opening segments, in such a manner that a portion of the polymer melt was extruded through the I-shaped opening segments at a smaller extruding rate than that of another position of the polymer melt extruded through the core opening segment. It was found that a sinuous filamentary stream of the polymer melt extruded through the core opening segment was formed while varying the thickness thereof in pulsing form, and was connected to two belt-shaped filamentary streams of the polymer melt extruded through the I-shaped opening segment through two filamentary streams of the polymer melt extruded through the thin slit-formed opening segments. Further, it was found that the resultant irregular multifilament yarn was useful for producing a bulky woven or knitted fabric having a high bulkiness and a uniform dyeing property.

SUMMARY OF THE INVENTION

An object of the present invention is to provide a synthetic polymer multifilament yarn capable of being converted to a bulky yarn or woven or knitted fabric which exhibits a high and even bulkiness and uniform dyeing and shrinking properties, and a process for producing the same.

Another object of the present invention is to provide a synthetic polymer multifilament yarn capable of being converted to a bulky yarn or woven or knitted fabric having a silky gloss and draping property, and a process for producing the same.

Still another object of the present invention is to provide a synthetic polymer multifilament yarn capable of being converted to a bulky yarn or woven or knitted fabric having an enhanced antistatic property and an improved moisture-absorbing property, and a process for producing the same.

The above-mentioned objects are attained by the synthetic polymer multifilament yarn and the process for producing the same of the present invention.

The synthetic polymer multifilament yarn of the present invention consists of a plurality of irregular individual filaments, each of which individual filaments comprises a filament-forming synthetic polymer and is composed of:

(A) at least two belt-shaped filamentary constituents each extruding along the longitudinal axis of the filament and, (B) at least one core filamentary constituent sinuously extending in wave form along the longitudinal axis of the filament, having a thickness thereof varying alternately between thick and thin, and arranged between the belt-shaped filamentary constituents, (C) at least two middle filamentary constituents each extending along the longitudinal axis of the filament and located between the core constituent and the belt-shaped constituents to connect the core constituent to the belt-shaped constituents therethrough, and in each of which individual filaments, (a) the core constituent has a cross-sectional profile segment having an inscribed circle having a diameter (lB);

(b) the belt-shaped constituents have substantially I-shaped cross-sectional profile segments;

(c) the middle constituents have waist-formed cross-sectional profile segments having narrowest portions thereof; and (d) cross-sectional regions consisting of the I-shaped cross-sectional segments and half portions of the middle cross-sectional segments located between the I-shaped segments and lines drawn along the narrowest portions of the middle constituents have inscribed circles having diameters (lCB) smaller than the diameter (lB) of the inscribed circle of the core segment.

The process of the present invention comprises the steps of:

(A) extending a melt of a filament-forming synthetic polymer through a spinneret having a plurality of spinning openings, each of which openings is composed of at least two substantially I-shaped opening segments in the form of a slit, at least one core opening segment arranged between the I-shaped opening segments, and at least two thin slit-shaped middle opening segments located between the core opening segment and the I-shaped opening segments and connecting the core opening segment to the I-shaped opening segments therethrough to form a continuous spinning opening, in a manner such that a portion of the polymer melt is extended through the core opening segment at an larger flow speed than that of another portion of the polymer melt extruded through the I-shaped opening segments to cause the extruded polymer melt core filamentary constituent stream to sinuously travel in a wave form, while varying the thickness thereof in a pulsing condition, and to be connected to polymer melt filamentary constituent streams extruded in the form of a belt through the I-shaped opening segments through polymer melt middle filamentary constituent streams extruded through the middle opening segments to form a body of a filamentary stream;

(B) cool-solidifying the filamentary stream; and (C) taking up the resultant solidified multifilaments.

DESCRIPTION OF THE PREFERRED EMBODIMENTS

The multifilament yarn of the present invention comprises a filament-forming synthetic polymer material comprising at least one member selected from the group consisting of polyesters and polyamides.

The multifilament yarn of the present invention is composed of a plurality of specific individual irregular filaments each consisting of at least two belt-shaped filamentary constituents, at least one core filamentary constituent located between the belt-shaped filamentary constituents, and at least two middle filamentary constituents through which the core filamentary constituent is connected to the belt-shaped filamentary constituents, all the above-mentioned filamentary constituents extending along the longitudinal axis of the filament. The core filamentary constituent sinuously extends in a wave form, while varying the thickness thereof in a pulsing condition, along the longitudinal axis of the filament.

Generally, the core filamentary constituent has a smaller average degree of orientation than that of the belt-shaped filamentary constituents.

Since the core filamentary constituent is sinuous and has a thickness varying alternately larger and smaller in a pulsing condition along the longitudinal axis of the filament, the thermal shrinkage of the core filamentary constituent varies alternately larger and smaller in a pulsing condition along the longitudinal axis of the filament. That is, in the core filamentary constituent, the thick portions thereof have a smaller shrinkage than that of the thin portions thereof.

Also, the thickness of the individual filament of the present invention is uneven and varies alternately larger and smaller in a pulsing condition along the longitudinal axis of the filament.

Preferably, in each of the individual filaments, a ratio ($d_1/d_2$) of the longest denier ($d_1$) thereof to the smallest denier ($d_2$) thereof is 2 or less, more preferably 1.5 or less. The largest denier ($d_1$) is of a thickest portion of the filament and the smallest denier ($d_2$) is of a thinnest portion of the filament.

In the individual filament, the belt-shaped filamentary constituents have an even thickness, degree of orientation, and thermal shrinkage. Therefore, even though the core filamentary constituent has an uneven thickness, if the ratio $d_1/d_2$ is 2.0 or less, the resultant individual filament exhibits, as a whole, a substantially even dyeing property.

Figure 4:
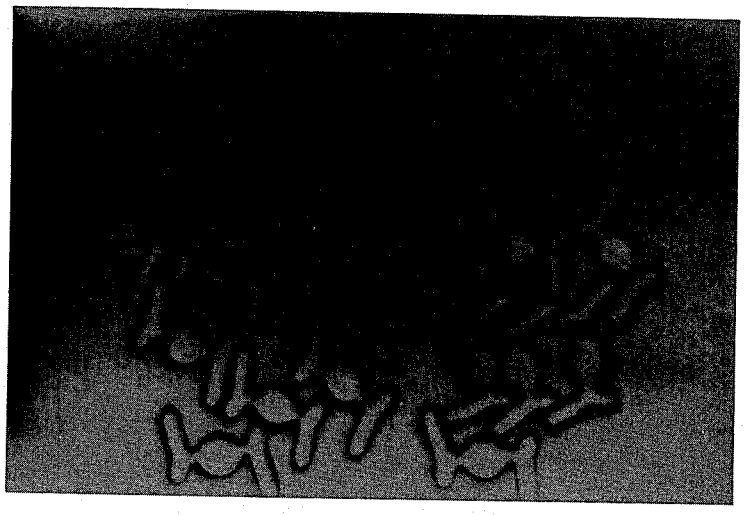
FIG. 4 shows cross-sections of a plurality of individual filaments of the type shown in FIG. 1.

When the ratio $d_1/d_2$ is 2.0 or less, the cross-sections of a number of the individual filaments in the multifilament yarn of the present invention are substantially the same as each other, as shown in FIG. 4.

Figure 1:
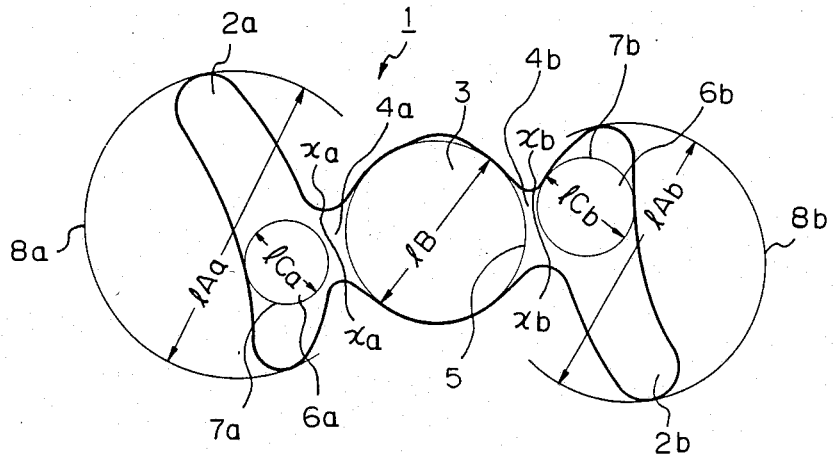
FIG. 1 is a cross-sectional profile of an embodiments of the individual filaments in the multifilament yarn of the present invention.

Referring to FIG. 1 which shows a cross-sectional profile of an embodiment of the individual irregular filaments in accordance with the present invention, the cross sectional profile 1 is composed of a pair of substantially I-shaped segments **2*a* and 2*b*, a core segment 3 arranged between the I-shaped segments 2*a* and 2*b* and two waist-shaped middle segments 4*a* and 4*b*, through which the core segments 3 is connected to the I-shaped segments 2*a* and 2*b* respectively. The waist-shaped middle cross-sectional segments 4a and 4b have narrowest portions indicated by lines Xa—Xa and Xb—Xb. That is, each of the waist-shaped middle segments 4a and 4b is divided by the line Xa—Xa or Xb—Xb into a half portion connected to the core segment 3 and another half portion connected to the I-shaped segment 2a or 2b**.

In FIG. 1, the core segment 3 has an inscribed circle 5 having a diameter lB. Also, a cross-sectional region 6a composed of the I-shaped segment 2a and the half portion of the middle segment 4a connected to the I-shaped segment 2a has an inscribed circle 7a having a diameter $lC_a$. Another cross-sectional region 6b composed of the I-shaped segment 2b and the half portion of the middle segment 4b connected to the I-shaped segment 2b has an inscribed circle 7b having a diameter $lC_b$.

In the individual irregular filament of the present invention, the diameters lC ($lC_a$, $lC_b$) of the inscribed circle of the regions composed of the I-shaped segments and the half portions of the middle segments connected to the I-shaped segments is smaller than the inscribed circle of the core segment. That is, lB>lC.

As mentioned above, the individual filaments in the multifilament yarn of the present invention have an even dyeing property over the whole length thereof. However, in the production of the individual filaments, the belt-shaped filamentary constituents are formed under a larger shearing stress than that in the formation of the core filamentary constituent, and thus the resultant belt-shaped filamentary constituents have a larger degree of orientation than that of the resultant core filamentary constituent. Also, the core filamentary constituent is sinuous and has a thickness which varies so as to alternately increase and decrease in a pulsing condition along the longitudinal axis thereof, and thus has an uneven shrinking property varying in a pulsing condition in response to the variance of the thickness thereof. Furthermore, the individual irregular filament of the present invention has a relative large apparent volume due to the complicated configuration thereof. Accordingly, the multifilament yarn of the present invention exhibits an excellent capability of forming a bulky yarn having an even dyeing property. The cross-sectional profile of the individual irregular filament as shown in FIG. 1, is asymmetric and the middle segments 4a and 4b are in the waist having the narrowest portions Xa—Xa and Xb—Xb. Due to the above-mentioned features of the cross-sectional profile, the individual filaments have a relatively large apparent volume, a relatively large difference in shrinking property between the core filamentary constituent and the belt-shaped filamentary constituents, and a capability of forming a high bulky yarn.

Figure 2:
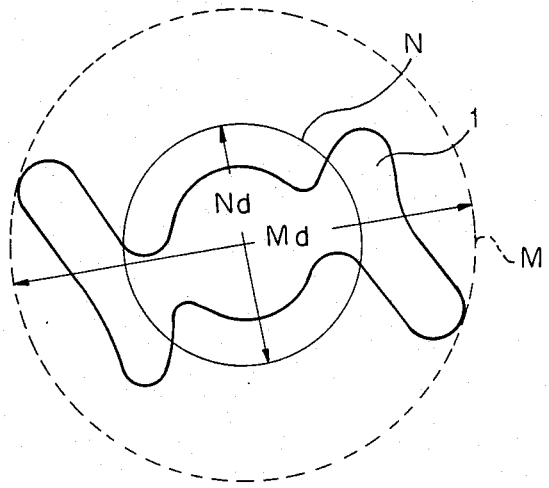
FIG. 2 is a comparative view of a cross-sectional profile of an embodiment of the individual filaments in the multifilament yarn of the present invention with a cross-sectional view of a conventional regular filament.

Referring to FIG. 2, a cross-sectional profile 1 of an individual irregular filament of the present invention has a circumcircle M having a diameter $M_d$. The circle N represents a cross-sectional profile of a regular individual filament having the same denier as that of the irregular individual filament having the cross-sectional profile M. The circle N has a diameter $N_d$. Preferably, the ratio of $M_d$ to $N_d$ is 1.5 or more, more preferably 2.0 or more.

Referring to FIG. 1, the I-shaped segments 2a and 2b have circumcircles 8a and 8b, respectively. The circumcircle 8a has a diameter $lA_a$. The circumcircle 8b has a diameter $lA_b$. Preferably, $lA_a$ and $lA_b$ are larger the lB.

Generally, the cross-sectional profile of each individual filament of the present invention satisfies the following relationships (I), (II), and (III):

$$lA \geqq lB > lC \quad \text{(I)}$$

$$15 > (lA/lC) \quad \text{(II)}$$

$$\text{and } SG/SH \leqq 4 \quad \text{(III)}$$

wherein lA represents diameters of circumcircles of the I-shaped segments, lB and lC are as defined above, SG represents an area of the core cross-sectional profile segment, and SH represents the sum of the areas of the I-shaped cross-sectional profile segment and the half portion of the middle cross-sectional profile segment between the narrowest portions X—X thereof and the I-shaped segment.

When lA<lB and SG/SH>4, the cross-sectional area of the core filamentary constituent having a relatively small degree of orientation becomes very large in comparison with the other segments, and thus increases the difference in shrinking property between the core filamentary constituent and the belt-shaped filamentary constituents.

Also, when lB<lC, the cross-sectional areas of the belt-shaped filamentary constituents, which have a relatively large degree of orientation, become very large, and thus increase the difference in shrinking property between the core filamentary constituent and the belt-shaped filamentary constituent.

Where $lA/lC \geqq 15$, the cross-sectional thickness of the belt-shaped filamentary constituents becomes too small, and thus the filament-forming procedure (spinning procedure) for the individual irregular filaments becomes difficult.

Figure 6:
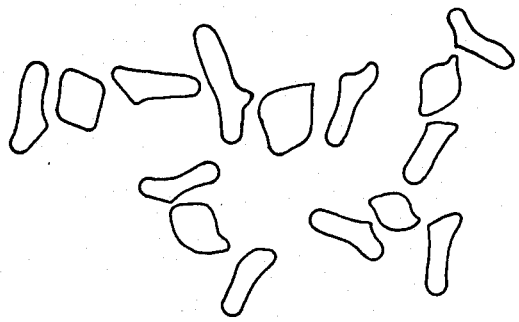
FIG. 6 shows a cross-sectional profile of an embodiment of the individual filaments in the multifilament yarn of the present invention, which was treated with an alkali aqueous solution to reduce the weight of the yarn.

To ensure an easy spinning procedure, preferably the ratio lA/lC is in the range of from 2 to 10.

Where the individual filament have two or more belt-formed filamentary constituent having different widths, preferably a ratio $D_{max}/D_{min}$ of a diameter $D_{max}$ of a circumcircle of a I-shaped cross-sectional profile segment of a widest belt-shaped filamentary constituent to a diameter $D_{min}$ of that of a narrowest belt-shaped filamentary constituent is in the range of from 1 to 10.

Where the individual filament satisfies the relationship (IV):

$$lC > lD \quad \text{(IV)}$$

wherein lC is as defined above and lD represents a smallest cross-sectional length of the narrowest portions X—X of the waist-formed middle cross-sectional profile segments, the individual filament is easily divided into two or more fine filaments as shown in FIG. 6 by applying an alkali treatment thereto. That is, the alkali treatment causes the waist-formed middle filamentary constituents to be cut by dissolving the narrowest portions thereof.

The alkali-treated multifilament yarn of the present invention exhibits a silky gloss and an enhanced draping property.

Of course, when heat-treated without an alkali treatment, the resultant multifilament yarn of the present invention also exhibits a satisfactory bulkiness.

Figure 3A:
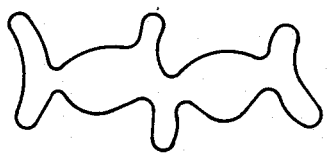
FIGS. 3A, 3B, and 3C, respectively, show a cross-sectional profile of another embodiment of individual filaments in the multifilament yarn of the present invention.
Figure 3B:
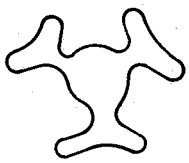
Figure 3C:
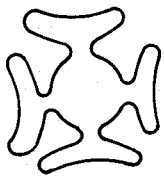

The individual filaments of the present invention may have the cross-sectional profiles as indicated in FIGS. 3A, 3B, and 3C.

In the cross sectional profile shown in FIG. 3A, the core filamentary constituents in the number of n which is 2 or more, preferably 2 or 3 the belt-shaped filamentary constituents in the number of n+1, and the middle filamentary constituent in the number of 2n are arranged in series in a manner such that the core filamentary constituents are arranged between the belt-shaped filamentary constituents and connected to the belt-shaped filamentary constituents through the middle filamentary constituents. These individual filaments form a multifilament yarn of the present invention which exhibits a capability of forming a high bulky yarn and a superior draping property without the alkali treatment.

Referring to the cross-sectional profile indicated in FIG. 3B, the individual filament is composed of a core filamentary constituent, three belt-shaped filamentary constituents surrounding the core filamentary constituent, and three middle waist-formed filamentary constituents through which the core filamentary constituent is connected to the belt-shaped filamentary constituents.

Referring to the cross-sectional profile indicated in FIG. 3C, the individual filament consists of a core filamentary constituent and four belt-shaped filamentary constituents surrounding and connected to the core filamentary constituent through waist-formed middle filamentary constituents.

The types of individual filaments shown in FIGS. 3B and 3C exhibits an enhanced moisture-absorbing property and/or an improved antistatic property.

In the cross-sectional profile of the individual filaments of the present invention, the core filamentary constitutent preferably has a substantially circular, triangular, or quadrilateral cross-sectional profile, more preferably a substantially circular cross-sectional profile. The core filamentary constituent having the circular cross-sectional profile simplifies the production of the individual irregular filaments.

Figure 5A:
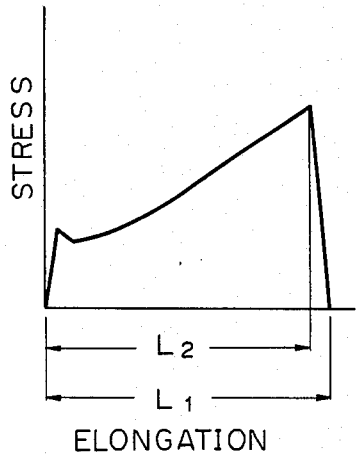
FIGS. 5A and 5B respectively show stress-strain curves of an undrawn individual filament and of a drawn individual filament produced in accordance with the process for the present invention.
Figure 5B:
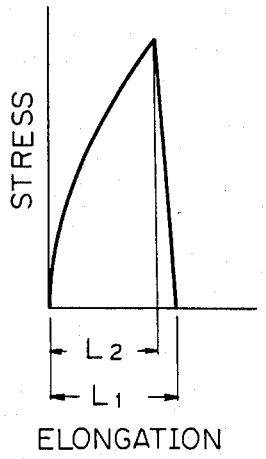

In the multifilament yarn of the present invention, preferably the individual filament exhibits a stress-strain curve shown in FIG. 5A when non-drawn and another stress-strain curve shown in FIG. 5B when drawn.

In FIGS. 5A and 5B, L1 represents an ultimate elongation in % of an individual filament at break, and L2 represents an elongation in % of the individual filament at a largest stress of the filament.

The smaller the difference L1−L2, the smaller the variance in thickness of the individual filament along the longitudinal axis of the filament. The individual filament preferably has the relationship (V):

$$L1-L2 \leqq 15\% \qquad (V)$$

Where the multifilament yarn of the present invention is used for clothes, preferable the individual filaments exhibits a Young's modulus of 1500 kg/mm$^2$ or less, more preferably 700 to 1500 kg/mm$^2$, and a silk factor (tensile strength$\times\sqrt{\text{ultimate elongation}}$) of 20 or less. The resultant clothes will exhibit a very soft touch and an enhanced draping property.

When the multifilament yarn of the present invention is textured by a false twisting method, the resultant textured individual filaments exhibit modified cross-sectional profiles. For example, the false twisting procedure applied to the multifilament yarns of the present invention causes the cross-sectional profiles shown in FIGS. 1, 3A, 3B, and 3C, respectively, to be modified to those shown in FIGS. 7A, 7B, 7C, and 7D.

In the past, the false-twisted textured multifilament yarns have been required only to exhibit a high bulkiness and stretchability. However, recently, multifilament yarns are required to have various additional properties and functions.

For example, Japanese Examined Patent Publication (Kokoku) No. 56-13810 discloses a synthetic polymer textured multifilament yarn having an enhanced gloss and produced by false-twisting a multifilament yarn composed of a number of individual filaments having an irregular cross-sectional profile.

Japanese Unexamined Patent Publication (Kokai) No. 56-49322 discloses a false-twisted multifilament yarn in which a number of individual filaments are locally fuse-bonded to each other, and thus has an alternately twisted yarn-like structure and a linen-like touch and appearance.

Japanese Examined Patent Publication (Kokoku) No. 59-20003 discloses a false twisted multifilament yarn composed of a number of individual filaments each having a variance in thickness along the longitudinal axis of each filament.

However, the above-mentioned false-twisted multifilament yarns have an unsatisfactory touch, appearance, and evenness in dyeing property, and therefore, are not suitable for high quality woven or knitted fabrics.

As clearly shown in FIGS. 7A, 7B, 7C, and 7D, the false-twisted multifilament yarn of the present invention has very complicated and random cross-sectional configurations of the individual filaments and, therefore, the resultant textured yarn exhibits a high bulkiness and cotton-like elegant gloss. Also where the multifilament yarn of the present invention to be subjected to the false-twisting procedure has a spontaneous stretching property, the resultant textured yarn still retains the spontaneous stretching properties.

The spontaneous stretchable false-twisted multifilament yarn has an enhanced soft touch and draping property due to the unique cross-sectional profiles of the individual filaments.

When the multifilament yarn shown in FIG. 3A is false-twisted, the individual filaments are easily locally fuse-bonded to each other and a textured yarn having an alternately twisted multifilament yarn-like structure and appearance is obtained.

The alternately twisted yarn-like multifilament yarn of the present invention has alternately twisted portions formed with smaller intervals than those in the conventional alternately twisted yarn-like false-twisted multifilament yarn consisting of regular individual filaments having a circular cross-sectional profile, includes a number of small spaces formed between the individual filaments due to the complicated irregular cross-sectional configuration thereof, and thus exhibits a soft and dry touch and a stiff or frictional feel.

Even though the individual filaments in the multifilament yarn of the present invention vary in shrinking property due to the variance in thickness thereof along the longitudinal axis of the filament, the cycles of the variance are very small, and thus the false-twisted yarn fabric produced from the multifilament yarn of the present invention exhibit an improved uniform dyeing property in comparison with that of the false-twisted fabric produced from the conventional multifilament yarn as disclosed in Japanese Examined Patent Publication (Kokoku) No. 59-20003.

As mentioned above, the false-twisted multifilament yarn produced from the multifilament yarn of the present invention is useful for high quality woven or knitted fabrics, especially cotton fabric-like or linen fabric-like high quality woven or knitted fabrics which could not be obtained from conventional false-twisted multifilament yarn.

The specific multifilament yarn mentioned above is produced by the process of the present invention in which a melt of a filament-forming synthetic polymer is extruded through a melt spinneret having a plurality of specific spinning openings.

Figure 8:
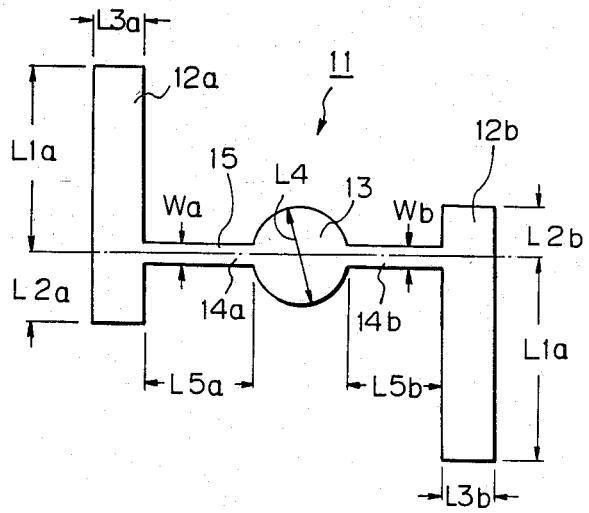
FIG. 8 is a plane view of a specific spinning opening usable for producing the individual filament shown in FIG. 1.

FIG. 8, shows an embodiment of the specific spinning openings usable for the process for the present invention.

In FIG. 8 a spinning opening 1 is composed of a plurality of substantially I-shaped opening segments 12*a* and 12*b* extending substantially in parallel to each other, a core opening segment 13 located between the I-shaped opening segments 12*a* and 12*b* and a plurality of very thin slit-shaped middle opening segments 14*a* and 14*b*, through which the core opening segment 13 is connected to the I-shaped opening segments 12*a* and 13*a* respectively.

The core opening segment 13 is in the form of a circle and has a diameter of L4. The left middle opening segment 14*a* has a width $W_a$ and a length $L5_a$. The right middle opening segment 14*b* has a width $W_b$ and a length $L5_b$.

In FIG. 8, the left I-shaped opening segments 12*a* has a width $L3_a$ and a length $(L1_a+L2_a)$, which are divided by a center line 15 of the core opening segment 13 and of the middle opening segments 14*a* and 14*b*.

Also, the right I-shaped opening segment 12*b* has a width 13*b* and a length $(L1_b+L2_b)$ divided by the center line 15.

The spinning opening 11 shown in FIG. 8 is asymmetric.

In the process of the present invention, a portion of the polymer melt is flow spaced the I-shaped opening segments 12*a* and 12*be* at a smaller flow speed than that of another portion of the polymer melt extruded through the core opening segment. The resultant belt-shaped filamentary streams (Y1) extruded through the I-shaped opening segments 12*a* and 13*b* do not come into direct contact with the resultant core filamentary stream (Y2) extruded through the core opening segment 13, because the I-shaped opening segments 12*a* and 12*b* are separated from the core opening segment 13 through the thin slit-shaped middle opening segments 14*a* and 14*b*. Therefore, the belt-shaped filamentary streams (Y1) are connected to the core filamentary stream through the thin middle filamentary stream (Y3) extruded through the middle opening segments 14*a* and 14*b*, while allowing the core filamentary stream (Y) extruded at a relatively small flow speed to sinuously travel and to vary the thickness thereof in the pulsing condition so as to alternately increase and decrease the thickness at a very small cycle. That is, the core filamentary stream (Y2) does not come into direct contact with the belt-shaped filamentary streams (Y1) and is waved in directions parallel to the belt-shaped filamentary stream (Y1).

If the spinning opening has no middle opening segments, the core filamentary stream (Y2) comes into direct contact with the belt-shaped filamentary streams (Y1) while sinuously traveling and varying the thickness thereof in the pulsing condition at a large cycle. Therefore, the resultant multifilament yarn exhibits a remarkably uneven dyeing property along the longitudinal axes of the filaments, and thus the resultant woven or knitted fabric is unevenly dryed.

In the process of the present invention, the thickness of the core filamentary stream (Y2) can be varied at a very small varying circle, in comparison with that in the process disclosed in U.S. Pat. Nos. 4,546,043 and 4,631,162.

In the process of the present invention, it is important for the core filamentary stream (Y2) to travel sinuously while varying the thickness thereof in the pulsing condition. If this is not accomplished, the resultant multifilament yarn will exhibit a very small variance in shrinking property between the core filamentary constituent and the belt-shaped filamentary constituents, and thus a poor capability of being converted to a bulky yarn. The resultant woven or knitted fabric will not be bulky but will be a paper-like sheet.

In order to create the core filamentary stream (Y2) which travels sinuously while varying the thickness thereof in the pulsing condition, preferably the ratio V2/V1 of flow speed rate V2 of the core filamentary stream (Y2) of the polymer melt extruded through the core opening segment 13 to the flow speed V1 of the belt-shaped filamentary streams (Y1) of the polymer melt extruded through the I-shaped opening segments 12*a* and 13*a* is in the range of from 1.5 to 5 that is, $1.5 \leqq V2/V1 \leqq 5$, more preferably from 2.5 to 4, that is, $2.5 \leqq V2/V1 \leqq 4$.

If the ratio V2/V1 is more than 5 or less than 1.5, the resultant core filamentary stream does not have a satisfactory sinuous travel and pulse-like variance in the thickness thereof.

The spinning opening suitable for forming the core filamentary stream having a satisfactory sinuous movement and pulse-like variance in the thickness thereof preferably satisfies the following relationships.

$$5 \geqq S1/S2 \geqq 0.5$$

$$S1 > S3$$

$$S2 > S3$$

$$30 \geqq \frac{L1 + L2}{L3} \geqq 2$$

$$W < L3 < L4,$$

$$0.10 \leqq L3/L4 \leqq 0.50$$

$$0.10 \leqq W/L4 \leqq 0.45$$

$$0.30 \leqq W/L3 \leqq 0.80$$

$$0.1\ \text{mm} \geqq L3 > W > 0.05\ \text{mm}$$

$$0.1\ \text{mm} \leqq L4 \leqq 2.0\ \text{mm}$$

$$0.2\ \text{mm} \leqq L5 \leqq 2.0\ \text{mm}$$

wherein S1 represents a cross-sectional area of the I-shaped opening segment, S2 represents a cross-sectional area of the core opening segments, S3 represents a cross-sectional area of the thin slit-shaped middle opening segments, and W, L1, L2, L3, L4, and L5 are as defined above.

In the spinning opening as shown in FIG. 8, the two I-shaped opening segments substantially in parallel to each other and the core opening segment in the substantially circular form are preferable for convenience during the production of the spinning opening. When the spinning opening is asymmetric as shown in FIG. 8, the resultant individual filament preferably has a large difference in shrinking property between the filamentary constituents in the filament.

In the spinning orifice having the spinning opening shown in FIG. 8, and usable for the process of the present invention, the orifice portions corresponding to the opening segments have the same land length, whereas in the spinning orifice usable for the process disclosed in U.S. Pat. Nos. 4,332,757 and 4,349,604, the orifice portions corresponding to different opening segments must have different land lengths.

The process of the present invention will be further explained with reference to FIG. 8.

Generally, when a polymer melt is extruded separately through a slit-shaped spinning opening and a substantially circular opening at the same flow speed, the slit-shaped spinning opening generates a larger pressure loss on the polymer melt extruded therethrough than that generated on the polymer melt extruded through the substantially circular spinning opening.

In the process of the present invention, in which a polymer melt is extruded through the specific spinning opening and in which the core opening segment is connected to the I-shaped opening segments through thin slit-shaped middle opening segments, differential flow speeds are generated between the resultant core filamentary stream, belt-shaped filamentary streams and middle filamentary streams, so that the pressure losses generated at the core opening segment, I-shaped opening segments, and thin slit-shaped middle opening segments become the same.

Accordingly, the belt-shaped filamentary streams extruded through the I-shaped opening segments with a large pressure loss travels at a smaller flow speed $V_1$ 1 than a flow speed $V_2$ of the core filamentary stream extruded through the core opening segment with a small pressure loss. That is, $V_1 < V_2$.

In the process of the present invention, the core filamentary stream having a high flow speed is restricted by the middle filamentary stream connected thereto, and thus travels sinuously while the thickness thereof is varied in the pulsing condition, without direct contact with the belt-shaped filamentary streams having a low flow speed, the resultant whole filamentary stream is cool-solidified, and the resultant solid filament is taken up. Before the cool-solidifying step, the belt-shaped filamentary streams having a low flow speed are drafted under a larger shearing force than that applied to the core filamentary stream having a high flow speed, while being cooled at a larger cooling rate than that of the core filamentary stream. Therefore, the resultant belt-shaped filamentary constituents have a higher degree of orientation than that of the resultant core filamentary constituent.

Figure 9A:
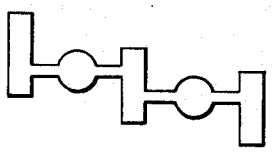
FIGS. 9A, 9B, and 9C, respectively, are a plane view of another spinning opening usable for producing the individual filament shown in FIGS. 3A, 3B, and 3C.

Referring to FIG. 9A, a spinning opening is composed of three I-shaped opening segments, two core opening segments arranged between the I-shaped opening segments, and four thin slit-shaped middle opening segments through which the core opening segments are connected to the I-shaped opening segments.

This type of spinning opening is useful for producing a multifilament yarn of the present invention capable of being connected to a very bulky fabric having an enhanced draping property.

Figure 9B:
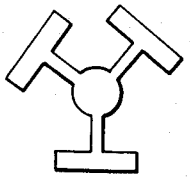

Referring to FIG. 9B, a spinning opening is composed of one core opening segment, three I-shaped opening segments arranged around the core opening segment, and three thin slit-shaped middle opening segments through which the core opening segment is connected to the I-shaped opening segments.

Figure 9C:
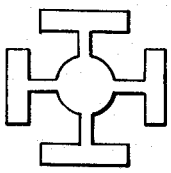

Referring to FIG. 9C, a spinning opening is composed of a core opening segment, four I-shaped opening segments arranged around the core opening segment, and four thin slit-shaped opening segments through which the core opening segment is connected to the I-shaped opening segments.

The spinning openings as shown in FIGS. 9B and 9C are useful for producing a multifilament yarn of the present invention having an enhanced antistatic property and moisture-absorbing property.

In the spinning openings shown in FIGS. 9A, 9B, and 9C, the shape of the core opening segment may be modified to a triangle or quadrilateral.

Figure 10:
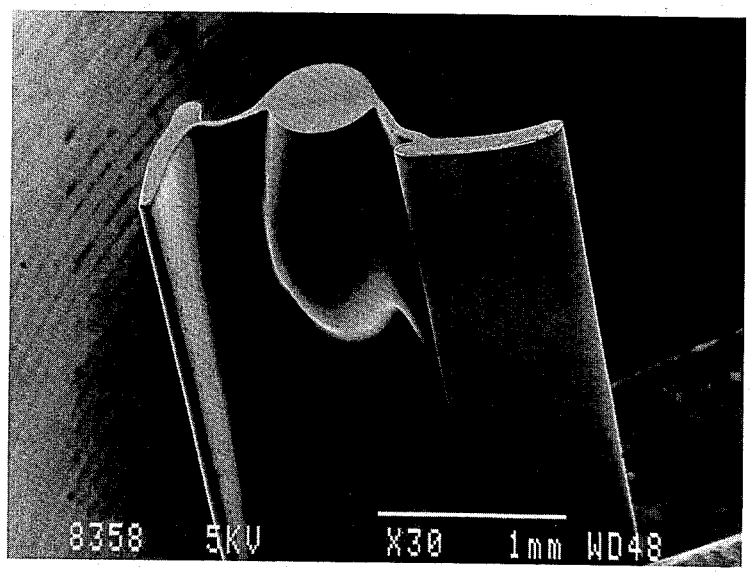
FIG. 10 is a microscopic picture of an undrawn individual filament produced by extruding a polymer melt through the spinning opening indicated in FIG. 8 while allowing the extruded fillamentary stream to full free; and, FIG. 11 is a microscopic picture of an undrawn individual filament produced by extruding a polymer melt through the spinning opening indicated in FIG. 9A while allowing the extruded fillamentary stream to fall free.

FIG. 10 shows a microscopic view of an individual filament of the present invention produced by extruding a polymer melt through the spinning opening as shown in FIG. 8, while allowing the extruded filamentary stream to fall free.

Figure 11:
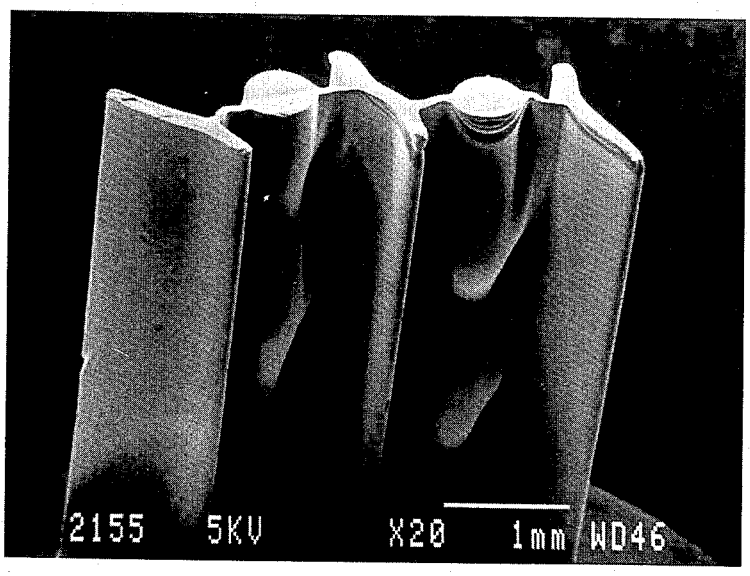

FIG. 11 shows a microscopic view of an individual filament of the present invention produced by extruding a polymer melt through the spinning opening shown in FIG. 9A, while allowing the extruded filamentary stream to fall free.

FIGS. 10 and 11 clearly show that each core filamentary constituent sinuously extends between the belt-shaped filamentary constituents without direct contact with the belt-shaped filamentary constituents and the thickness of each core filamentary constituent varies in a pulsing condition, along the longitudinal axis of the filament.

As shown in FIGS. 10 and 11, since the I-shaped filamentary constituents are connected to the core filamentary constituent through thin middle filamentary constituents, the I-shaped filamentary constituents are flexible around the core filamentary constituent.

However, where a polymer melt is extruded through the spinning opening shown in FIGS. 8 or 9A, the resultant belt-shaped filamentary streams are drafted substantially parallel to each other under a drafting force.

The middle filamentary streams are extruded in a very thin membrane form through thin slit-shaped middle opening segments, and some portions thereof are incorporated into the I-shaped filamentary streams and to the core filamentary streams so that the remaining portions thereof form the waist-formed middle filamentary constituents.

The cool-solidified filaments are taken up at a predetermined speed. When the taking-up speed is less than 4000 m/min sometimes the resultant multifilament yarn exhibits unsatisfactory mechanical properties, and thus must be drawn and heat-treated. The drawing and heat-treating procedures may directly follow the melt-spinning procedure or may be applied to the taken-up multifilament yarn after the melt-spinning procedure.

When the taking-up speed is 4000 m/min or less, preferably in the range of from 4500 m/min to 6500 m/min, the undrawn multifilament yarn of the present invention has satisfactory mechanical strengths and is usable in practice without drawing and heat-treating.

In the present invention, the core filamentary constituent, the belt-shaped filamentary constituents, and the thin middle filamentary constituents may consist of the same polymer material or of different polymers.

The polyester multifilament yarn of the present invention or a fabric made of the polyester multifilament yarn may be treated with an aqueous alkali solution at an elevated temperature so that the weight of the yarn or fabric is reduced by 10% to 30%.

As mentioned above, the polyester individual filaments in the multifilament yarn of the present invention can be divided into a plurality of thin filaments by the alkali treatment, and the resultant multifilament yarn exhibits an enhanced silky gloss and droping property.

The alkali treatment can be applied to the multifilament yarn of the present invention under conventional treating conditions.

The multifilament yarn of the present invention can be converted to a textured yarn by a false-twisting method, while being drawn, for example, under the following conditions:

Heater temperature: 100° to 220° C., preferably

Speed: 200 to 500 m/min

The draw ratio to be applied to the multifilament yarn is adjusted so that the resultant drawn, false twisted yarn exhibits an ultimate elongation of 15% to 30%.

The filament-forming synthetic polymer resin usable for the present invention is preferably selected from polyester resins and polyamide resins.

The polyester is preferably selected from polyethylene terephthalate polymers containing at least 85 molar % of recurring units consisting of ethylene terephthalate. The polyester resin may contain at least one member selected from delusterants, dyeing property-promoting agents, and antistatic agents as an additive or a copolymerized component. Especially, since the individual filaments of the present invention have a very complicated cross-sectional profile, preferably the polymer resin contains a viscosity-controlling agent or thickener.

Also, preferably the polyester resin exhibits an intrinsic viscosity of 0.45 to 1.2, more preferably 0.5 to 1.0, determined in orthochlorophenol at a temperature of 35° C. When the intrinsic viscosity is less than 0.45, the resultant individual filaments sometimes have an unsatisfactory mechanical strength, and when the intrinsic viscosity is more than 1.2, the resultant polymer melt exhibits a too high viscosity and thus the melt spinning procedure must be carried out at an undesirably high temperature.

The polyamide usable for the present invention is selected from aliphatic polyamides, for example, nylon 4, nylon 6, nylon 66, and nylon 10, preferably nylon 6 and nylon 66. The polyamide resin preferably contains a delusterant, dyeing property-promoting agent, and/or antistatic agent as an additive or copolymerized component.

The multifilament yarn of the present invention consisting of a polyamide resin exhibits an excellent water-absorbing property and moisture-absorbing property. Especially, when individual filaments having the cross-sectional profile shown in FIG. 3A are made from a polyamide resin, the resultant multifilament yarn exhibits a unique property such that when the yarn absorbs moisture or water, the yarn is converted to a very bulky yarn.

In the process of the present invention, the flow speed of the core filamentary constituent stream extruded through the core opening segment is larger than that of the belt-shaped filamentary constituent streams extruded through the I-shaped opening segments. The core filamentary constituent stream does not come into direct contact with the belt-shaped filamentary constituent streams, however, the movement of the core filamentary constituent stream is restricted by the thin middle filamentary constituent streams. Therefore, the core filamentary constituent stream travels in a sinuous manner while pulsing the thickness thereof along the longitudinal axis of the filament. The pulsing cycle in the thickness of the core filamentary stream is smaller than that in the individual filament disclosed in U.S. Pat. Nos. 4,546,043 and 4,631,162, and the whole filamentary stream is solidified by cooling while being drafted, the belt-shaped filamentary constituent streams extruded at a low flow speed are drafted at a larger draft ratio at a larger cooling rate than those of the core filamentary constituent stream and, therefore, are forced with a larger shearing force than that of the core filamentary constituent stream, to generate a higher degree of orientation in the belt-shaped filamentary constituent constituents than that in the core filamentary constituent constituent.

Therefore, the shrinking property of the resultant individual filament of the present invention has a variance derived from a variance in the thickness thereof. However, the variance in dyeing property of the individual filament along the longitudinal axis of the filament is practically negligible.

Thus, the resultant multifilament yarn of the present invention exhibits a uniform dyeing property and can be easily converted to a very bulky yarn by heat-treating.

A fabric made from the multifilament yarn of the present invention can be evenly dyed without generating strip-shaped blotches.

Also, by applying an alkali treatment, the individual filaments of the present invention are divided into fine filaments and the multifilament yarn can be a bulky yarn having a silky gloss and an enhanced draping property.

Further, the multifilament yarn of the present invention produced by using the specific spinning opening shown in FIGS. 9A, 9B or 9C, exhibits an enhanced draping property, water-absorbing property, and antistatic property.

The present invention will be further illustrated by the following examples.

In the examples, the following measurements were carried out.

(1) Measurement of lA, lB, lC and lD

A cross-section of a filament to be tested was photographing by using a microscope at a magnification of from 1,000 to 2,000. The lA, lB, lC, and lD shown in the resultant microscopic picture were measured.

(2) Tensile strength and ultimate elongation

A specimen was subjected to a tensile test by using an ordinary tensile strength tester at a testing length of 10 cm, a temperature of 25° C., a relative humidity of 60%, and a tensile speed of 200 mm/min to provide a stress-strain curve. A tensile strength and ultimate elongation at break, and an elongation at largest stress of the specimen were determined from the stress-strain curve.

(3) Young's modulus

A specimen was stretched at a testing length of 250 mm at a tensile speed of 50 mm/min, and a stress of the specimen at an elongation of 1% was determined.

A Young's modulus of the specimen was obtained from the equation:

$$Ym = \frac{\text{Stress (g) at 1\% elongation}}{\text{Denier of specimen}} \times 900 \times W_G$$

wherein Ym represents a Young's modulus of the specimen in kg/mm$^2$ and $W_G$ represents a specific gravity of the specimen.

The specific gravity ($W_G$) of the specimen was determined in accordance with an ordinary density gradient tube method using a mixture of tetrachloromethane and n-heptane.

(4) Shrinkage

A multifilament yarn was formed into a hank. The hank was immersed in boiling water while under a load of 2 mg/d. The shrinkage of the hank was determined in accordance with the following equation.

$$SH\ (\%) = \frac{l_0 - l_1}{l_0} \times 100$$

wherein SH represents a shrinkage in % of the hank, $l_0$ represents a length of the original hank before boiling water-treatment, and $l_1$ represents a length of the hank treated with the boiling water.

(5) Bulkiness of multifilament yarn

A multifilament yarn was wound around a hank frame having a peripheral length of 1.125 m at a turning number of 320. A hank was removed from the frame and was dry heated at a temperature of 180° C. for 5 minutes while under a load of 6 g applied to a lower end of the hank. The heat-treated hank was cooled without loading. The apparent volume of the hank was measured at a load of 6.4 g. The bulkiness of the hank was determined in accordance with the following equation.

$$Bu = \frac{V_0}{W_t}$$

wherein Bu represent a bulkiness in cm$^3$/g of the hank, $V_0$ represent an apparent volume in cm$^3$ of the hank, and $W_t$ represents a weight in g of the hank.

(6) Feeling

A multifilament yarn was knitted to form a tube. The knitting was dyed with a disperse dye by an ordinary dying method, while allowing the knitted tube to be converted to a bulky knitted tube. The dyed bulky knitted tube was washed with water and then dried and heat-set at a temperature of 180° C. for one minute.

The feeling of the knitted tube was evaluated by touch and by observation with the naked eye.

(7) Alkali treatment

A polyester multifilament yarn was knitted to form a tube. The knitted tube was treated in an aqueous solution of 3% by weight of sodium hydroxide at a liquor ratio of 1:100 at boiling temperature of the solution. Thereafter, the treated knitted tube was washed with water and then dried.

The decrease in weight of the knitted tube was determined from the weights of the knitted tube before and after the alkali treatment.

EXAMPLE 1

A polyester resin consisting of a polyethylene terephthalate having an intrinsic viscosity of 0.64 and 0.6% by weight of sodium dodecylbenzenesulfonate was melted at a temperature of 300° C. and the polymer melt was extruded through a spinneret having 18 spinning orifices in the form indicated in FIG. 8 at an extruding rate of 37.5 g/min.

The spinning orifices had the dimensions shown in Table 1.

TABLE 1

| I-shaped opening segment | | | Core opening segment | Thin slit-shaped middle opening segment | | Cross-sectional area ratio |
|---|---|---|---|---|---|---|
| L1 | L2 | L3 | L4 | W | L5 | S1/S2 |
| 1.0 mm | 0.5 mm | 0.10 mm | 0.27 mmϕ | 0.06 mm | 0.70 mm | 2.6 |

Note:

$S1 = (L1 + L2) \times L3$ $S2 = \pi \left(\frac{L4}{2}\right)^2$

The ratio (Q1/Q2) of the extruding rate Q1 of the melt through each I-shaped opening segment to the extruding rate Q2 of the melt through the core opening segment was adjusted to 1/1 and the ratio ($V_1/V_2$) of the flow speed ($V_1$) of each belt-shaped filamentary stream to the flow speed ($V_2$) of the core filamentary stream was adjusted to 1.0/2.6.

At a location directly below the spinneret, the extruded filamentary streams of the melt were observed by a stroboscope, and as a result, it was confirmed that the core filamentary constituent stream travels in a sinuous manner while the thickness thereof varies alternately between thick and thin, without direct contact with the belt-shaped filamentary constituent streams.

The filamentary streams were solidified by cooling with cooling air at a temperature of 20° C., a relative humidity of 60%, and a linear blowing speed of 50 cm/sec, the solidified filaments were then oiled by an oiling roller, and taken up at a speed of 3000 m/min.

The resultant multifilament yarn had a yarn count of 113 denier/18 filaments.

The undrawn multifilament yarn was drawn while pre-heating, heat-treated by a slit heater, and taken up under the following conditions.

| Drawing heat-setting conditions | |
|---|---|
| Preheating temperature | 88° C. |
| Slit heater temperature | 220° C. |
| Draw ratio | 1.50 |
| Drawing speed | 500 m/min |

The resultant drawn, heat-set multifilament yarn had a yarn count of 75 denier/18 filaments and exhibited the properties shown in Table 2.

TABLE 2

| Properties of multifilament yarn | |
|---|---|
| Tensile strength | 2.6 g/d |
| Ultimate elongation | 28% |
| Shrinkage in boiling water | 6.0% |
| Silk factor* | 13.8 |
| Young's modulus | 1140 kg/mm$^2$ |
| Bulkiness | 24.2 cm$^3$/g |
| Dimensions of cross-sectional profile of individual filament | |
| lA/lB | 1.3 |
| lA/lC | 6.3 |
| lB/lC | 2.7 |

TABLE 2-continued

| | |
|---|---|
| SG/SH | 1.6 |

Note:

*silk factor = (Tensile strength) × $\sqrt{\text{ultimate elongation}}$ lA, lB, lC, SG and SH are respectively an average value.

Note, ordinary polyester multifilament yarn had a silk factor of about 30 and Young's modulus of 1600 to 2000 kg/mm$^2$.

That is, Table 2 clearly shows that the resultant bulky multifilament yarn of the present invention had a remarkably smaller silk factor and Young's modulus than those of ordinary polyester multifilament yarn, and a satisfactory bulkiness.

In the cross-sectional profile of the individual filaments, the diameter Md of the circumcircle M of the filament was 44.1 μm. The corresponding regular filament having the same denier as the individual filaments of the present invention had a diameter (Nd) of 20.7 μm.

The multifilament yarn was knitted to form a tube. The knitted tube was dyed under the following conditions.

Dye: Polyester Eastman Blue GLS (Trademark of disperse dye produced by Eastman Kodak)

Amount of Dye: 4% based on the weight of the knitted tube

Auxiliary agent: Monogen (Trademark of an anionic surfactant made by Daiichi Kogyo Seiyaku K.K.) in an amount of 0.5 g/l Liquor ratio: 1/100

Dyeing temperature: 100° C.

Dyeing time: 60 minutes

The dyed knitted tube was washed with water, dried, and then heat-set at a temperature of 180° C. for one minute.

The resultant dyed knitted tube was evenly colored without variance in color depth and had a soft touch, a satisfactory draping property, a silky gloss and a superior bulkiness.

EXAMPLE 2

The same multifilament yarn knitted tube as described in Example 1 was treated with an alkali solution under the following conditions.

Alkali: Sodium hydroxide

Concentration: 3% by weight

Liquor ratio: 1/100

Temperature 100° C.

Time: 50 minutes

The treated knitted tube was washed with water, dried, and then heat-set at 180° C. for one minute.

The decrease in weight of the knitted tube derived from the treatment was 15%, based on the original weight of the knitted tube.

The resultant knitted tube exhibited an enhanced soft touch, bulkiness, and draping property, and a satisfactory frictional and rigid feel.

The alkali-treated multifilament yarn had the cross section shown in FIG. 6 and contained fine irregular individual filaments.

COMPARATIVE EXAMPLE 1

The same procedures as those described in Example 1 were carried out except that a comparative spinneret having the spinning openings indicated in Table 3 was used.

TABLE 3

| I-shaped opening segment (mm) | | | Core opening segment (mm) | Thin slit-shaped middle opening segment (mm) | | Cross-sectional area ratio |
|---|---|---|---|---|---|---|
| L1 | L2 | L3 | L4 | W | L5 | S1/S2 |
| 0.8 | 0.40 | 0.10 | 0.38 ϕ | 0.06 | 0.44 | 1.1 |

The extruding rate ratio Q1/Q2 was adjusted to 1.0/5.1 and the flow speed ratio $V_1/V_2$ was adjusted to 1.3/5.4.

The extruded filamentary streams were observed at a location directly below the spinneret, and as a result, it was confirmed that the thickness of the core filamentary stream did not vary. This is because the extruding rate of the core filamentary constituent stream was very large, the extruding rate of each belt-shaped filamentary constituent stream was very small, and therefore, each small belt-shaped filamentary constituent stream was easily incorporated into the large core filamentary stream.

The resultant comparative solidified undrawn multifilament yarn had a yarn count of 113 denier/18 filaments. The undrawn yarn was converted to a drawn yarn having a yarn count of 75 denier/18 filaments under the same conditions as those mentioned in Example 1.

The individual filaments of the drawn comparative multifilament had the properties and dimensions as indicated in Table 4.

TABLE 4

| | | |
|---|---|---|
| Properties of comparative multifilament yarn | Tensile strength | 4.0 g/d |
| | Ultimate elongation | 30% |
| | Shrinkage | 6.1% |
| | Silk factor | 21.9 |
| | Young's modulus | 1580 kg/mm$^2$ |
| | Bulkiness | 13 cm$^3$/g |
| Dimensions of comparative individual filament | lA/lB | 0.7 |
| | lA/lC | 2.9 |
| | lB/lC | 4.3 |
| | SG/SH | 5.0 |

The properties of the comparative multifilament yarn were close to those of ordinary polyester multifilament yarns, and the comparative yarn had a relatively poor bulkiness. This indicates that the variances in shrinking property of the individual filament between the core filamentary constituent and the belt-shaped filamentary constituents and along the longitudinal axis of the filament were very small and could not be converted to a bulky yarn.

The comparative dyed knitting prepared in the same manner as described in Example 1 was evenly colored and exhibited a paper-like stiff touch.

The comparative multifilament yarn was treated with an alkali solution in the same manner as described in Example 2. It was found that the individual filaments were not divided into fine filaments and the resultant filament yarn exhibited an unsatisfactory soft touch, draping property, and frictional feel.

EXAMPLE 3

The same spinning, drawing and heat-setting procedures as those described in Example 1 were carried out except that the extruding rate, take-up speed, and draw ratio were changed as indicated in Table 5.

The resultant multifilament yarn exhibited the properties as indicated in Table 5.

TABLE 5

| Run No. | Production: Extruding rate (g/min) | Take-up speed (m/min) | Draw ratio | Properties of multifilament yarn: Tensile strength (g/d) | Ultimate elongation (%) | Shrinkage (%) | Silk factor | Young's modulus (kg/mm²) | Bulkiness (cm³/g) |
|---|---|---|---|---|---|---|---|---|---|
| 1 | 35.0 | 1500 | 2.8 | 3.3 | 20 | 7.0 | 15.0 | 1450 | 17.5 |
| 2 | 41.7 | 2500 | 2.0 | 2.8 | 28 | 6.4 | 13.2 | 1250 | 23.8 |
| 3 | 35.0 | 3500 | 1.4 | 2.6 | 22 | 6.4 | 12.3 | 1240 | 28.7 |
| 4 | 45.0 | 4000 | 1.2 | 2.4 | 23 | 9.0 | 11.5 | 1220 | 27.8 |

Table 3 shows that the silk factor and the Young's modulus of the multifilament yarn tend to decrease with an increase in the take-up speed in the spinning procedure.

The multifilament yarn of the present invention generated a superior bulkiness to that of an ordinary polyester drawn multifilament yarn, even when produced at a small take-up speed.

EXAMPLE 4

The same procedures as those mentioned in Example 1 were carried out except that, in the spinning opening shown in FIG. 8, the length L5 of the thin slit-shaped middle opening segments was changed to 0.90 mm, and the take-up speed was as indicated in Table 6. Also, a region 10 cm below the spinneret was heated at a temperature of 250° C. The resultant undrawn multifilament yarn had a yarn count of 100 denier/18 filaments, and exhibited the properties shown in Table 6.

TABLE 6

| Run No. | Spinning: Extruding rate (g/min) | Take-up speed (m/min) | Properties of multifilament yarn: Tensile strength (g/d) | Ultimate elongation (%) | Shrinkage (%) | Silk factor | Young's modulus (kg/mm²) | Bulkiness (cm³/g) |
|---|---|---|---|---|---|---|---|---|
| 1 | 50.0 | 4500 | 2.5 | 51 | 5.2 | 17.9 | 704 | 20.3 |
| 2 | 52.2 | 4700 | 2.7 | 50 | 4.4 | 19.1 | 740 | 22.0 |
| 3 | 53.9 | 4850 | 2.8 | 49 | 4.0 | 19.6 | 817 | 20.1 |
| 4 | 55.6 | 5000 | 2.9 | 47 | 3.7 | 19.9 | 847 | 22.8 |
| 5 | 61.1 | 5500 | 3.0 | 40 | 3.3 | 19.0 | 966 | 23.5 |
| 6 | 66.7 | 6000 | 3.2 | 33 | 2.7 | 18.4 | 1107 | 25.3 |
| 7 | 72.2 | 6500 | 3.4 | 31 | 2.5 | 18.9 | 1170 | 24.8 |

The undrawn multifilament yarns had a satisfactory tensile strength, ultimate elongation, and shrinkage in boiling water, and thus could be practically utilized.

The undrawn yarns were converted to knitted tubes without drawing, and the knitted tubes were dyed in the same manner as mentioned in Example 1. The dyed knitted tubes were evenly colored and had a soft touch.

The knitted tube made from the undrawn yarn prepared in Run No. 4 was treated with an alkali solution in the same manner as that described in Example 2. It was confirmed that the individual filaments in the yarn were divided into fine filaments as shown in FIG. 6 and the alkali-treated knitted tube exhibited an enhanced droping property.

The individual filaments produced in Run Nos. 1 to 5, wherein the take-up speed was in the range of from 4500 to 5500 m/min, exhibited a stress-strain curve close to the type shown in FIG. 5A, which other individual filaments of Run Nos. 6 and 7, wherein the take-up speed was 6000 and 6500 m/min, exhibited another stress-strain curve close to the type shown in FIG. 5B which was of a drawn filament.

EXAMPLE 5

The same procedures as those described in Example 1 were carried out except that the polyester resin was replaced by a nylon 6 resin having an intrinsic viscosity of 1.34 determined in m-cresol at a temperature of 35° C., the nylon 6 resin was melted at a temperature of 270° C. and was extruded at a extruding rate of 40 g/min.

The resultant undrawn multifilament yarn was preheated, drawn, heat-set by a slit heater and then taken up under the following conditions.

Preheating temperature: 60° C.
Slit heater temperature: 180° C.
Draw ratio: 1.30
Take-up speed: 500 m/min The resultant drawn multifilament yarn had a yarn count of 75 denier/18 filaments and exhibited the properties and dimensions shown in Table 7.

TABLE 7

| | | |
|---|---|---|
| Properties of multifilament yarn | Tensile strength | 2.9 g/d |
| | Ultimate elongation | 29% |
| | Shrinkage in boiling water | 7.3% |
| | Bulkiness | 24.8 cm³/g |
| | Stretchability of moistened yarn | 3% |
| Dimension of individual filament | lA/lB | 1.3 |
| | lA/lC | 6.3 |
| | lB/lC | 2.7 |
| | SG/SH | 1.6 |

The stretchability of moistened individual filaments was determined in the following manner.

The multifilament yarn was formed into a hank having a thickness of 100,000 denier. The hank was dry heated at a temperature of 120° C. for 30 minutes while not under tension and the resultant bulky hank was then moistened while not under tension by using a moistener at room temperature for 30 minutes.

The stretchability of the moistened filament was determined in accordance with the following equation:

$$Em\ (\%) = \frac{E1 - E0}{E1} \times 100$$

wherein Em represents a stretchability in % of the moistened filament, E0 represents a length of the moistened hank under a load of 0.06 mg/d, and E1 represents a length of the moistened hank under a load of 5 mg/d.

Table 7 clearly shows that the resultant nylon 6 multifilament yarn could be converted to a very bulky yarn, and when moistened, the bulkiness of the bulky yarn increased, whereas the stretchability of moistened ordinary nylon 6 regular multifilament yarn was zero.

In the cross-sectional profile of the resultant individual filament, the circumcircle M of the filament had a diameter Md of 44.1 μm, while the corresponding circular cross-sectional profile N of a regular filament having the same denier as that of the resultant individual filament had a diameter Nd of 22.8 μm.

A portion of the resultant multifilament yarn was converted to a knitted tube and was dyed under the following conditions.

Dye: Suminol Milling Brilliant Sky Blue GG (Trademark of a acid dye made by Sumitomo Chemical)
Amount of dye: 0.4% based on the weight of the knitted tube
Acetic acid: 0.2 g/l
Liquor ratio: 1/100
Temperature: 100° C.
Time: 60 minutes The dyed knitted tube was evenly dark colored and exhibited a soft touch and high compressibility. Also, it was found that the knitted tube exhibited a remarkably reduced waxy touch, which is a characteristic property of the ordinary nylon 6 filament fabric, and an increased dry touch.

Separately, another portion of the multifilament yarn was knitted form a tube, was treated in boiling water to provide a bulky yarn, and was dried.

The dried bulky yarn exhibited the moisture content, water-absorbing rate, and water content shown in Table 8.

For comparison, the same procedures as mentioned above were applied to an ordinary nylon 6 regular multifilament yarn. The results are shown in Table 8.

TABLE 8

| Item | Moisture content | Water-absorbing rate | Saturated water content |
|---|---|---|---|
| Multifilament yarn of Example 5 | 8.3% | 16 cm | 60 g |
| Comparative regular multifilament yarn | 7.3% | 8 cm | 40 g |

The moisture content, water-absorbing rate and saturated water content of the yarns were determined in the following manner.

(1) Moisture content

A specimen was placed in a desiccator conditioned by 14.4% by weight of sulfuric acid and having a humidity of 95%, and was left therein at room temperature for 48 hours to moisten the specimen. The weight $W_1$ of the moistened specimen was measured. The specimen was then heated at a temperature of 100° C. for 3 hours to dry. The weight $W_2$ of the dried specimen was measured.

The moisture content in % is determined from the following equation.

$$\text{Moisture content (\%)} \frac{W_1 - W_2}{W_2} \times 100$$

(2) Water-absorbing rate

A specimen consisting of a knitted tube having a length of 30 cm was stood in a vessel containing a black ink in such a manner that a lower end portion having a length of 2 cm of the specimen was immersed in the black ink, so as to allow the black ink to be absorbed in the specimen and to be drawn up along the specimen. The height of the absorbed and drawn up black ink layer from the level of the black ink in the vessel was measured 60 minutes after the start of the immersion. The water-absorption rate of the specimen is represented by the height of the elevated black ink layer.

(3) Saturated water content

A specimen consisting of a knitted tube was immersed in water at a temperature of 20° C. for 10 minutes. The wet specimen was then dehydrated by a home dehydrator for 5 minutes and the weight $W_3$ of the dehydrated specimen was measured. The specimen was dried by heating at a temperature of 100° C. for 2 hours and the weight $W_4$ of the dried specimen was measured.

The saturated water content in % of the specimen was determined in accordance with the following equation:

$$\text{Saturated water content \%} = \frac{W_3 - W_4}{W_4} \times 100$$

Table 8 clearly shows that the nylon 6 multifilament bulky yarn of Example 5 had an enhanced water-absorbing property and moisture-absorbing property, and thus was suitable for forming a confortable cloth material.

EXAMPLE 6

The same procedures as those described in Example 1 were carried out except that a polyethylene terephthalate resin having an intrinsic viscosity of 0.72 was melted at a temperature of 310° C. and was extruded at an extruding rate of 35 g/min through a spinneret having 48 spinning openings having the configuration shown in FIG. 8. The resultant undrawn multifilament yarn had a yarn count of 105 denier/48 filaments.

The undrawn yarn was simultaneously drawn and false twisted under the following conditions.

Draw ratio: 1.40
Heater length: 150 cm
Heater temperature: 200° C.
Processing speed: 300 m/min
False twister: Friction type (Surface speed=480 m/min)

The resultant textured yarn had a tensile strength of 2.2 g/d, an ultimate elongation of 15%, a percentage crimp of 8.1%, and a shrinkage of 4.0%.

Figure 7A:
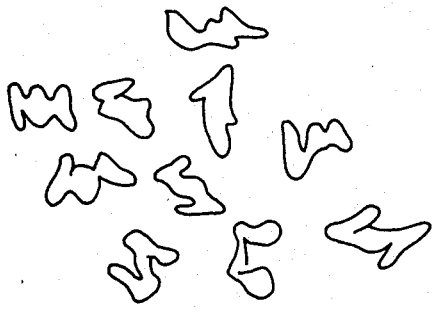
FIGS. 7A, 7B, 7C, and 7D, respectively, show a cross-sectional profile of the individual filament shown in FIGS. 1, 3A, 3B, and 3C, which was textured by a false twisting method.

The textured yarn had the cross-section shown in FIG. 7A.

The textured multifilament yarn was converted to a knitted tube and was dyed and heat-set in the same manner as that described in Example 1.

It was confirmed that the dyed knitted tube was evenly colored and exhibited a soft touch, an enhanced dyeing property, a silky gloss, and a satisfactory bulkiness.

EXAMPLE 7

The same procedures as those described in Example 1 were carried out except that the spinneret had 10 spinning openings having the configuration shown in FIG. 9A, and the polymer melt was extruded at a extruding rate of 34.7 g/min.

The resultant undrawn multifilament yarn had a yarn count of 104 denier/10 filaments.

The extruded filamentary streams of the polymer melt were observed by a stroboscope at a location directly below the spinneret. It was confirmed that the two core filamentary constituent streams traveled in a sinuous manner between the belt-shaped filamentary constituent streams without direct contact with the belt-shaped filamentary constituent streams, and the thickness of the core filamentary constituent streams varied alternately between thick and thin as shown in FIG. 11.

The undrawn multifilament yarn was simultaneously drawn and false-twisted under the following conditions.

Draw ratio: 1.30

Heater length: 150 cm

Heater temperature: 120° C.

Processing speed: 300 m/min

The resultant textured multifilament yarn had a yarn count of 80 denier/10 filaments and exhibited a tensile strength of 1.5 g/d, an ultimate elongation of 28%, a percentage crimp of 4.5%, and a shrinkage of 7.4%.

Figure 7B:
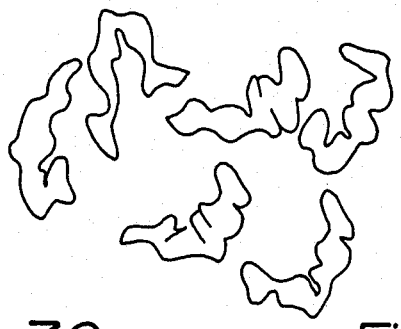
Figure 7C:
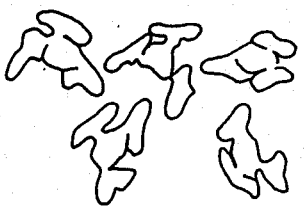
Figure 7D:
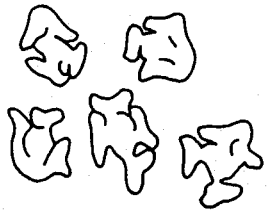

The textured multifilament yarn had a number of alternately twisted portions formed at small intervals and a cross-section as shown in FIG. 7B.

The textured multifilament yarn was converted to a knitted tube and dyed in the same manner as that described in Example 1.

The dyed knitted tube was evenly colored and had a linear-like dry touch which was not coarse.

We claim:

1. A synthetic polymer multifilament yarn capable of being converted to a bulky yarn, consisting of a plurality of irregular individual filaments, each of which individual filaments comprises a filament-forming synthetic polymer and is composed of:

(A) at least two belt-shaped filamentary constituents each extending along the longitudinal axis of the filament;

(B) at least one core filamentary constituent sinuously extending in wave form along the longitudinal axis of the filament, having a thickness thereof varying alternately between thick and thin and arranged between the belt-shaped filamentary constituents; and (C) at least two middle filamentary constituents each extending along the longitudinal axis of the filament and located between the core constituent and the belt-shaped constituents to connect the core constituent to the belt-shaped constituents therethrough, and in each of which individual filaments:

(a) the core constituent has a cross-sectional profile having an inscribed circle thereof having a diameter (lB);

(b) the belt-shaped constituents have a substantially I-shaped cross-sectional profile;

(c) the middle constituents have a waist-formed cross-sectional profile having a narrowest portion thereof; and (d) cross-sectional regions consisting of the I-shaped cross-section segments and half portions of the middle cross-section segments located between the I-shaped segments and lines drawn along the narrowest portions of the middle segments have inscribed circles having diameters (lC) smaller than the diameter (lB) of the inscribed circle of the core segment.

2. The multifilament yarn as claimed in claim 1, wherein the core filamentary constituent has an average degree of orientation smaller than that of the belt-shaped filamentary constituents.

3. The multifilament yarn as claimed in claim 1, wherein the core constituent has an uneven shrinkage varying alternately between large and small along the longitudinal axis of the core constituent.

4. The multifilament yarn as claimed in claim 3, wherein in the core filamentary constituent, the thick portions have a smaller shrinkage than that of the thin portions thereof.

5. The multifilament yarn as claimed in claim 1, wherein each of the individual filaments has an uneven thickness thereof varying alternately between large and small along the longitudinal axis thereof.

6. The multifilament yarn as claimed in claim 5, wherein each of the individual filaments has a ratio ($d_1/d_2$) of the largest denier ($d_1$) to the smallest denier ($d_2$) thereof of 2 or less.

7. The multifilament yarn as claimed in claim 1, wherein the cross-sectional profile of each individual filament, satisfies the following relationships (I), (II) and (III):

$$lA \geqq lB > lC \quad \text{(I)}$$

$$15 > (lA/lC) \quad \text{(II) and}$$

$$SG/SH \leqq 4 \quad \text{(III)}$$

wherein lA represents diameters of circumcircles of the I-shaped cross-sectional profile segments, lB and lC are as defined above, SG represents a cross-sectional area of the core segment, and SH represents a cross-sectional area of the sum of the I-shaped segment and the half portions of the middle segments located between a line drawn in the narrowest portion thereof and the I-shaped segment.

8. The multifilament yarn as claimed in claim 1, wherein the middle cross-section segments satisfy the relationship (IV):

$$lC > lD \quad \text{(IV)}$$

wherein lC is as defined above and lD represents a smallest cross-sectional length of the narrowest portions of the waist-formed middle segments.

9. The multifilament yarn as claimed in claim 1, wherein the cross-sectional profiles of the individual filaments are asymmetric.

10. The multifilament yarn as claimed in claim 1, wherein the cross-sectional profiles of the individual filaments have a circumcircle having a diameter which is at least 1.5 times greater than a diameter of a circular cross-sectional profile of a regular filament having the same denier as that of the individual filaments.

11. The multifilament yarn as claimed in claim 1, wherein the core constituents of the individual filaments have a substantially circular cross-sectional profile.

12. The multifilament yarn as claimed in claim 1, wherein each individual filament consists of n core filamentary constituents, n being 2 or more, the belt-shaped filamentary constituents to the number of n+1 and the middle filamentary constituents to the number of 2n, which constituents are arranged in such a manner that the core constituents are located between the belt-shaped constituents and the core and belt-shaped constituents are connected through the middle constituents.

13. The multifilament yarn as claimed in claim 1, wherein each individual filament has a single core filamentary constituent and at least three belt-shaped filamentary constituents surrounding the single core filamentary constituent and connected to the core filamentary constituent through the middle filamentary constituents in the same number as the belt-shaped filamentary constituents.

14. The multifilament yarn as claimed in claim 1, wherein each individual filament satisfies the relationship (V):

$$L_1 - L_2 \leqq 15\% \quad \text{(V)}$$

wherein $L_1$ represents an ultimate elongation in % a break of the individual filament and $L_2$ represents an elongation in % of the individual filament at a largest stress of the filament.

15. The multifilament yarn as claimed in claim 1, wherein each individual filament has a Young's modulus of 1500 kg/mm$^2$ or less.

16. The multifilament yarn as claimed in claim 1, wherein each individual filament has a silk factor of 20 or less, the silk factor being defined by $$T \times \sqrt{L_1}$$

wherein T represents a tensile strength in g/d of the individual filament and $L_1$ is as defined above.

17. The multifilament yarn as claimed in claim 1, wherein the individual filaments comprise a filament-forming polymer selected from the groups consisting of polyesters and polyamides.

* * * * *